United States Patent [19]

LaBounty et al.

[11] Patent Number: 5,044,569

[45] Date of Patent: Sep. 3, 1991

[54] ROCK AND CORAL DEMOLITION TOOL

[76] Inventors: Roy E. LaBounty, HC2, Box 105E; Kenneth R. LaBounty, Rte. 1, Box 164B, both of Two Harbors, Minn. 55616

[21] Appl. No.: 451,506

[22] Filed: Dec. 15, 1989

[51] Int. Cl.[5] ..... B02C 1/06

[52] U.S. Cl. ..... 241/266; 241/101.7; 225/103

[58] Field of Search ..... 30/134, 228, 180; 83/694; 414/739, 740; 299/85, 88, 67; 125/23 R, 23.01; 225/103, 23; 294/106, 902; 241/101.7, 264–269

[56] References Cited

U.S. PATENT DOCUMENTS

| | | | |
|---|---|---|---|
| 2,760,265 | 8/1956 | Draenert . | |
| 3,814,152 | 6/1974 | Pallari . | |
| 3,972,097 | 8/1976 | Schakat . | |
| 4,005,894 | 2/1977 | Tucek . | |
| 4,017,114 | 4/1977 | LaBounty . | |
| 4,104,792 | 8/1978 | LaBounty . | |
| 4,168,729 | 9/1979 | Tausig et al. | 83/694 X |
| 4,188,721 | 2/1980 | Ramun et al. . | |
| 4,196,862 | 4/1980 | Tagawa . | |
| 4,198,747 | 4/1980 | LaBounty . | |
| 4,217,000 | 8/1980 | Watanabe . | |
| 4,274,457 | 6/1981 | Nilsen . | |
| 4,382,625 | 5/1983 | LaBounty . | |
| 4,439,921 | 4/1984 | Ramun . | |
| 4,512,524 | 4/1985 | Shigemizu . | |
| 4,519,135 | 5/1985 | LaBounty . | |
| 4,536,976 | 8/1985 | Holopainen . | |
| 4,543,719 | 10/1985 | Pardoe | 30/228 X |
| 4,558,515 | 12/1985 | LaBounty . | |
| 4,670,983 | 6/1987 | Ramun . | |
| 4,776,524 | 10/1988 | Sakato . | |
| 4,838,493 | 6/1989 | LaBounty . | |
| 4,890,798 | 1/1990 | Tagawa et al. | 241/101.7 X |
| 4,951,886 | 8/1990 | Berto | 241/101.7 |

OTHER PUBLICATIONS

Geith Brochure.
LaBounty Catalog.

*Primary Examiner*—Mark Rosenbaum
*Attorney, Agent, or Firm*—Palmatier & Sjoquist

[57] ABSTRACT

An attachment for a hydraulic excavator including a pair of jaws mounted on a frame and having offset points or projections on the jaws to apply localized pressure onto a rock or coral piece for breaking the workpiece. Both jaws are movable and operable by individual hydraulic cylinders. The direction of thrust against the jaws being tangential to the arc of movement of the pins for connecting the cylinders to the jaws at a location approximately midway of the operational arc of the jaws.

15 Claims, 3 Drawing Sheets

ROCK AND CORAL DEMOLITION TOOL

This application relates to copending U.S. patent application Ser. No. 451,377, filed on even date herewith by LaBounty et al entitled Demolition Tool for a Hydraulic Excavator, which is hereby incorporated by reference.

The present invention relates to a heavy-duty mobile demolition tool as an attachment for a hydraulic excavator and, more particularly, to a heavy-duty mobile demolition tool for crushing rocks and coral.

BACKGROUND OF THE INVENTION

During excavation operations, it is often desirable to crush boulders or large rocks into smaller pieces for transportation from an excavation site. The boulders or rocks typically encountered are of an assortment of different shapes and sizes. Likewise, coral structures are often of great, varying sizes with unpredictable shapes.

SUMMARY OF THE INVENTION

A feature of the present invention is the provision in a heavy-duty demolition for attachment to the boom structure and hydraulic system of a hydraulic excavator wherein the tool includes a frame with a pair of demolition jaws and at least one hydraulic cylinder pivotally moving at least one of the jaws relative to the frame and the other jaw, of the jaws having an array of tips which are staggered in relation to each other so that the tips will not directly confront each other as the jaws are closed.

Another feature of the present invention is the provision in such a heavy-duty demolition tool, of one of the jaws including at least two spaced apart heavy-duty plates disposed transversely of each other and of the hydraulic cylinder, wherein the other jaw includes a heavy-duty plate disposed medially of and substantially parallel to the spaced apart plates, and wherein each of the plates includes an integral staggered tip.

Another feature of the invention is the mounting of both upper and lower jaws for individual swinging with respect to the frame and with respect to each other. The cylinders operating the two jaws are connected to common manifolds so that one jaw may engage a workpiece and be stopped while the other jaw continues to swing toward the workpiece to engage it, after which maximum demolition force is applied by both jaws to the workpiece breaking it.

Another feature of the invention is to provide that both jaws swing during each operation for breaking a workpiece and that the operational arc for the jaws be relatively small to the extent that substantially maximum force is applied from the cylinders to the jaws and against the workpiece throughout all portions of the operational arc. The connections between the rams and cylinders and the jaws swing through such operational arc, and the directions of thrust of the cylinders will be tangent to the operational arc at said connections at a location intermediate the ends of the arc as to apply maximum demolition force to the jaws. When the directions of thrust are tangent to the operational arcs, the directions of thrust will be substantially perpendicular to the radii extending from the pivotal mounting of the jaws to the connections between the jaws and the rams.

An advantage of the present invention is that boulders, large pieces of concrete and coral structures of odd shapes and sizes may be readily crushed into smaller pieces for efficient transportation from an excavation or demolition site.

Another advantage of the present invention is that the tool is relatively simple and inexpensive to manufacture and operate.

BRIEF DESCRIPTION OF THE DRAWINGS

FIG. 2 is an elevation, partially broken away view of the tool illustrated in FIG. 1.

DETAILED DESCRIPTION OF THE PREFERRED EMBODIMENTS

Figure 1:
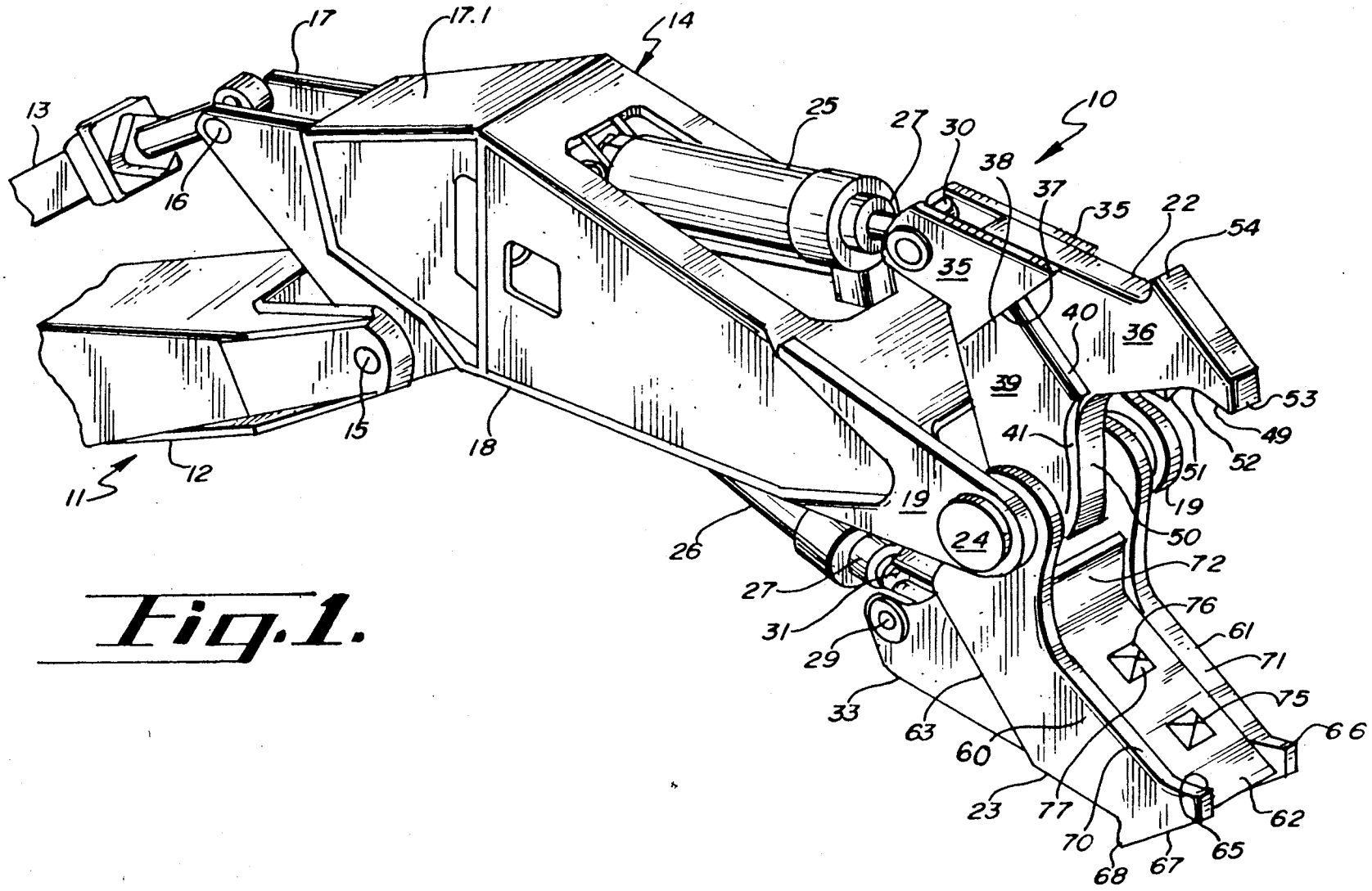
FIG. 1 is a perspective view of the demolition tool shown connected to the boom structure and hydraulic system of a hydraulic excavator.
Figure 6:
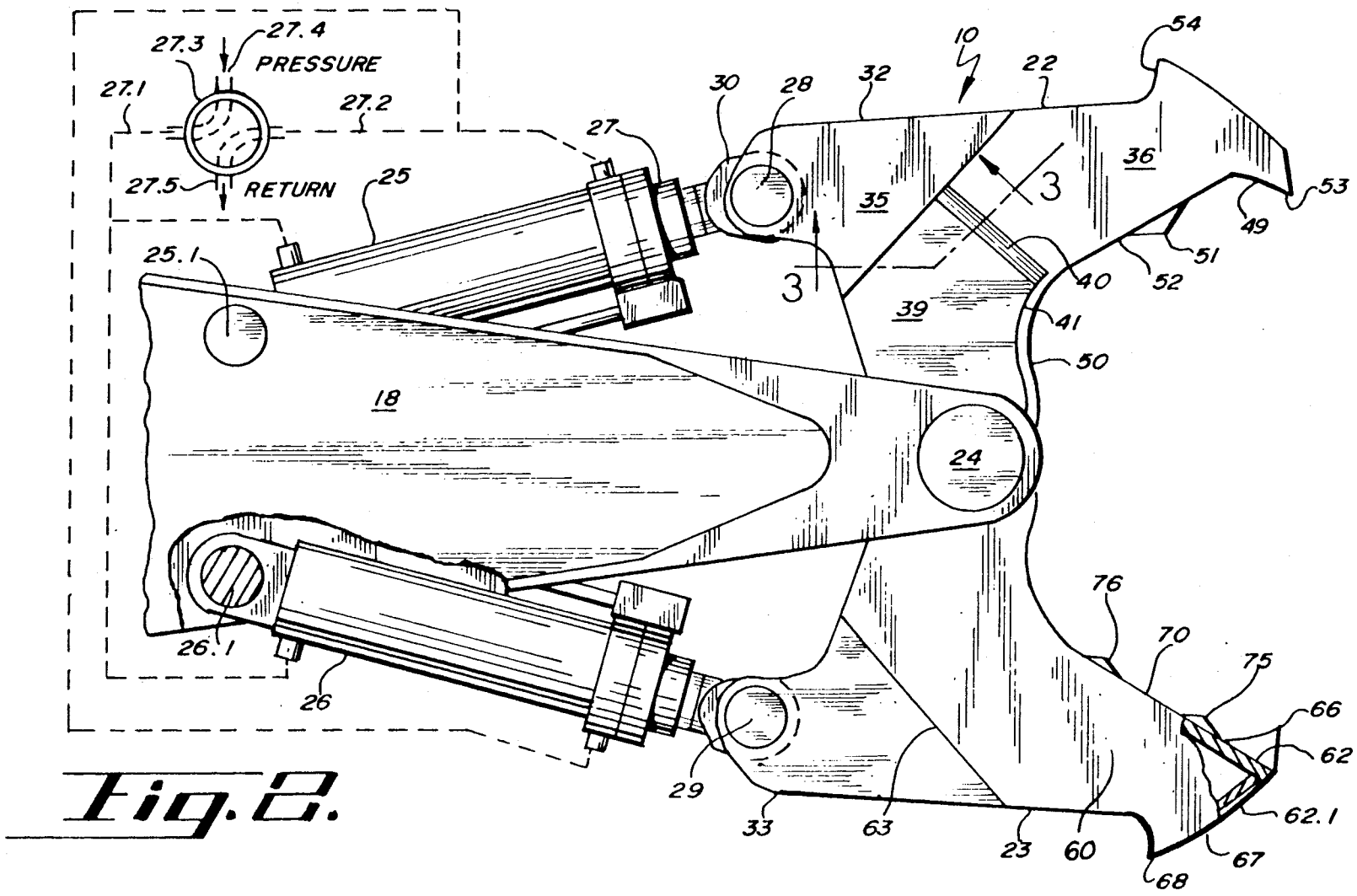
Figure 3:
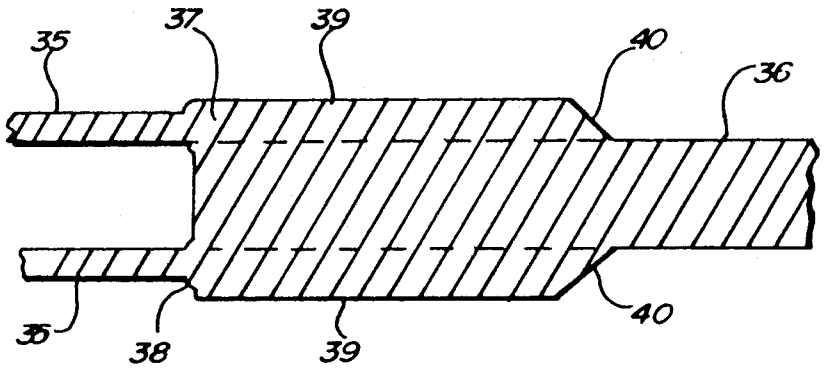
FIG. 3 is a detailed section view taken approximately at 3—3 of FIG. 2.
Figure 4:
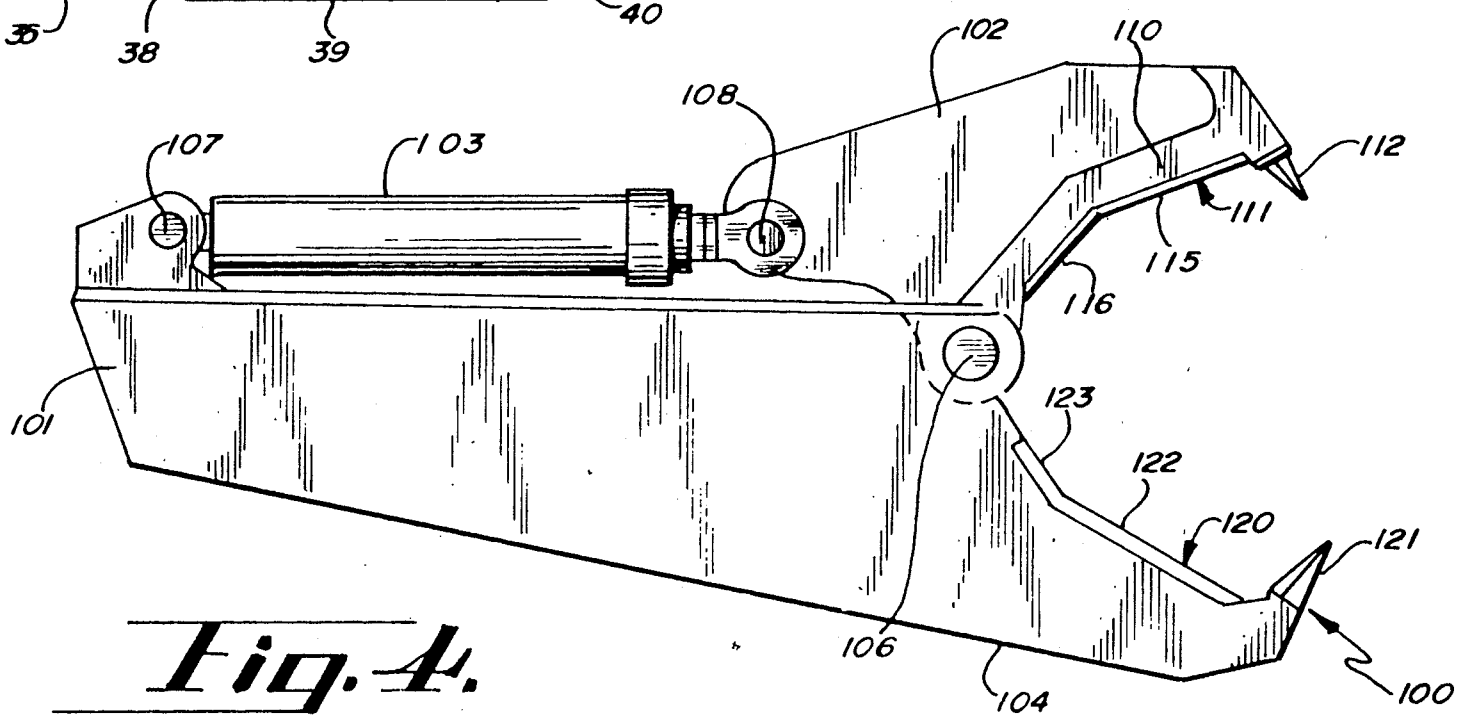
FIG. 4 is an elevation view of an alternate embodiment of the heavy-duty demolition tool for crushing coral.

The demolition tool is indicated in general by numeral 10 and comprises an attachment for a mobile power implement or hydraulic excavator indicated in general by numeral 11. A boom 12 of the implement 11 is adjacent to a main hydraulic cylinder 13 of the implement 11 manipulating the demolition tool 10. The demolition tool 10 has a frame means which is indicated in general by the numeral 14 and which is tiltably mounted by a mounting pin 15 on the boom structure 12 of the implement 11. The frame means 14 may be tilted to various angles by the hydraulic cylinder 13 which is connected to the frame means by a connector pin 16 as to control the attitude of the tool 10 in certain respects.

The frame means 14 includes a mounting or bracket portion 17 which is connected to the boom structure 12 via the mounting pin 15 into the hydraulic cylinder 13 via the connector pin 16. A box-like frame portion 17.1 is affixed to mounting portion 17 and to a jaw mounting frame 18 which includes connector portions 19.

The jaw mounting frame 18 mounts a pair of demolition jaws 22, 23 which are mounted on the connector portions 19 of frame 18 by a single removable pivot pin 24 about which the jaws 22 and 23 swing. The jaws 22, 23 are operated by extensible and retractable means in the form of hydraulic cylinders 25, 26. The cylinders 25, 26 includes rams 27 which are swingably connected by pins 28, 29 and thrust bearings 30, 31 to connector or bracket portions 32, 33 of the jaws 22, 23. The rear and front ends of the two cylinders are connected to common manifolds 27.1, 27.2 and to a reversing valve 27.3 which alternatively connects the manifolds to a pressure service line 27.4 and return line 27.5.

Because both jaws 22, 23 will swing as the cylinders 25, 26 are extended, the operational arc of swinging of each of the jaws is rather minimal and the total arc or swinging of each jaw may be in the general range of 50°–60°, but may be somewhat more or less. As a result of the arrangement of the connections between the cylinders and the jaws, the connections or connector pins 28, 29 will swing through the same operational arc, and at a location intermediate the ends of the operational arcs which correspond to the location which is intermediate the full extension and full retraction of the cylinders, the direction of the thrust from the cylinders 25, 26 will be substantially tangential to the operational arc circumscribed by the pins 28, 29 which are the connections to the jaws; and at the same location, the direction of thrust from the two cylinders will be perpendicular to the radii emanating from the pivot 24 to the connector pins 28, 29. The direction of thrust of the cylinders is between the rear mounting pin 25.1 for cylinder 25 and the connector pin 28 to the jaw; and from the rear mounting pin 26.1 of cylinder 26 to the pin 29 which is the connector pin for the lower jaw.

The demolition force at the faces of the jaws 22, 23 will be nearly maximum throughout the entire operational arc so that substantially maximum force may be applied to the workpiece whenever the jaws are substantially fully open or when the jaws may be substantially fully closed, as required according to the shape of the workpiece.

Connector portion 32 includes side connector portions 35. Each of the side connector portions 35 are welded to a respective side of a main plate 36 of the upper jaw 22. Each of the side connector portions 35 include a front edge 37. Each of the front edges 37 is welded to each of the rear edges 38 of side plate portions 39 which are welded to respective sides of the main plate 36. Each of the side portions 39 includes an upper beveled edge 40 and a front curved edge 41 which confronts and is bearably against objects crushed by the jaws 22, 23. Main plate 36 includes a lower edge 49 which includes a curved portion 50 which runs parallel to edges 41 of the side plate portions 39.

Jaw 22 includes an array of tips 51, 53, 54. The replaceable tooth-like point or tip 51 is welded to a linear portion 52 of edge 50. The second tooth-like point or tip 53 is formed integrally with and on a distal portion of the main plate 36. The jaw 22 also includes an upper tooth-like point or tip 54. Tip 53 may assist in retaining an object to be crushed between the jaws 22, 23. Tips 53, 54 may penetrate and crush objects between the jaws 22, 23.

The lower jaw 23 includes spaced apart plates 60, 61 joined by a cross plate 62 and distal cross plate 62.1. Each of the spaced apart plates 60, 61 includes a lower edge 63. Each of the lower edges 63 is welded to its respective connector portion 33. The spaced apart plates 60, 61 are disposed transversely of each other and of the hydraulic cylinders 25, 26 and lie in planes which are substantially parallel to the plane in which main plate 36 of jaw 22 lies.

The spaced apart plates 60, 61 include an array of tooth-like points or tips 65, 66 formed integrally with the plates 60, 61 and on distal portion 67 of the plates 60, 61. Each of the tips 65, 66 are staggered in relation to each of the tips 51, 53 of jaw 22 and will not directly confront either of the tips 51, 53 as the jaws 22, 23 are closed. When the jaws 22, 23 are in a closed position, tip 53 is disposed between and substantially in line with tips 65, 66. The line defined by tips 53, 65, 66 when the jaws 22, 23 are closed is substantially normal to each of the lines defined by the linearly extensible and retractable hydraulic cylinders 25, 26. Tips 65, 66 may cooperate with tip 53 in retaining objects placed between the jaws 22, 23 as well as penetrating and crushing the objects.

Each of the spaced apart plates 60, 61 also includes a second tooth-like point or tip 68 in its array of tips. The tips 68 are formed integrally with plates 60, 61 and distal portions 67, and are disposed in opposite directions relative to tips 65, 66.

The spaced apart plates 60, 61 further include respective lips 70, 71 which lie slightly above the cross plate 62. The lips 70, 71 may assist the cross plate 62 in cradling an object to be crushed. Cross plate 62 further includes an integral, inner bent portion 72 which may bear against portions of an object to be crushed, and assist in cradling an object.

The cross plate 62 further includes an array of replaceable tooth-like points or tips 75, 76 which are welded to the cross plate 62. Each of the tips 75, 76, as well as tip 51, includes four triangular faces 77 and is pyramid-like in shape. The tips 75, 76 are disposed nonlinearly relative to the tips 65, 66 and cooperate with the tips 65, 66 to assist the cross plate 62 and lips 70, 71 in the cradling of an object to be crushed.

Each of the tips 75, 76 are staggered in the relation to each of the tips 51, 53 of jaws 22 and will not directly confront either of the tips 51, 53 as the jaws 22, 23 are closed. When the jaws 22, 23 are in a closed position, tip 51 is disposed between and substantially in line with tips 75, 76 and tip 75 is disposed between and substantially in line with tips 51, 53. The line defined by tips 51, 53, 75, 76 lies in a plane defined by main plate 36. When the jaws 22, 23 are closed, the tips 51, 53, 65, 66, 75 and 76 form the shape of a "T" for inducing force or stress lines in an object to be crushed.

In operation, an object such as a boulder, section of concrete, or a coral structure is maneuvered, perhaps with the aid of outer tips 54, 68 between jaws 22, 23. The lower jaw 33 may cradle the object with one or more of the tips 65, 66, 75, 76, lips 70, 71, cross plate 62, and cross plate bent portion 72. As the jaws 22, 23 bear against an object, the staggered array of tips 51, 53, 65, 66, 75, 76 grab and penetrate different portions of the object, which is likely to have to have an odd shape, as to hold and induce stresses in the object. The jaws 22, 23 then continue to close with the tips 51, 53 of the upper jaw 22 and the tips 65, 66, 75, 76 of the lower jaw 23 indirectly confronting each other until the object is crushed into smaller pieces. When the jaws 22, 23 are in a closed position, the array of tips 51, 53, 65, 66, 75, 76 lies in a plane substantially the shape of a "T".

It should be noted that the jaws 22, 23 of hydraulic cylinders 25, 26 of the rock shear 10 operate substantially identical to the jaws 22, 23 and hydraulic cylinders 25, 26 of the copending LaBounty et al application entitled Demolition Tool for a Hydraulic Excavator, filed of even date herewith. In other words, cylinders 25, 26 of the rock shear 10 are connected by common manifolds with a reversing valve, high pressure pumps, and hydraulic fluid returns, and the relation between the jaw 22, 23, hydraulic cylinders 25, 26 and pivots 24, 28, 29 of the rock shear 10 is substantially identical to the demolition tool 10 of the copending LaBounty application, so as to cause substantially maximum force or thrust to be applied by the cylinders 25, 26 of the rock shear 10 to the jaws 22, 23 of the rock shear 10 throughout substantially the entire operational arcs of the jaws 22, 23.

In an alternate embodiment, a coral shear 100 is attachable to boom structure 12 of the frame portion 101. The coral shear 100 includes a swingable jaw 102 operated by a linearly extensible and retractable hydraulic cylinder 103, and a stationary jaw 104. The jaw 102 is swingable relative the jaw 104 by a single pivot pin 106. The hydraulic cylinder 103 is pivotally mounted to the frame 101 via pivot pin 107 and jaw 102 of the pivot pin 108.

Swingable jaw 102 includes a blade mounting portion 110 in which are welded a replaceable blade 111 and a replaceable elongate tooth-like point or tip 112. Blade 111 includes linear shearing edges 115, 116 which are disposed at an obtuse angle relative to each other.

Stationary jaw 104 includes a replaceable blade 120 and an elongate tooth-like point or tips 121 which are welded to the jaw 104. Blade 120 includes linear shearing edges 122, 123 which are disposed at an obtuse angle relative to each other. Each of the tips 112, 121 is pyramid-like with four triangular faces.

The blades 111, 120 are disposed in shearing relation as the blades 111, 120 do not directly confront each other. The array of tips 112, 121 are also staggered relative each other and do not directly confront each other.

In operation, the elongate tips 112, 121 bear into and penetrate the coral to be crushed and stabilize and retain the coral for the shearing blades 111, 120. Subsequently, the blades 111, 120 slice into the coral as the tips 112, 121 penetrate further into the coral. The coral is thus sliced into at least two pieces and typically breaks into more than two pieces before the jaws 102, 104 are fully closed.

The present invention may be embodied in other specific forms without departing from the spirit or essential attributes thereof. Therefore, the present methods should be considered in all respects as illustrative and not restrictive, reference being made to the appended claims rather than to the foregoing description to indicate the scope of the invention.

What is claimed is:

1. A heavy-duty mobile demolition tool for attachment to the boom and hydraulic system of a hydraulic excavator, comprising a frame means mountable on the boom, a pair of upper and lower demolition jaws pivotally connected to each other as to be opened and closed relative to each other, at least one of the jaws being pivotally mounted on the frame means as to be movable for opening and closing the jaws relative to each other, a hydraulic cylinder mounted on the frame means and connected with the at least one moveable jaw for producing swinging thereof, the upper jaw having a main plate with a lower edge having a tooth-like tip, the lower jaw having spaced apart plates with upper lips, a cross plate joining the spaced apart plates, and an array of tooth-like tips on the lips and cross plate which are indirectly confronting, staggered and linear in relation to the tip of the upper jaw when the jaws are pivoted to the closed position whereby a demolition force may be exerted against a material so as to cause breaking of it into smaller pieces.

2. The heavy-duty mobile demolition tool according to claim 1 wherein two tips of the array are centrally located on the cross plate in-line but staggered with the tip of the upper jaw.

3. A heavy-duty mobile demolition tool according to claim 1, and a distal cross plate on said spaced apart plates of the lower jaw and extending between and affixed to outer end portions of said spaced apart plates.

4. The heavy-duty mobile demolition tool according to claim 1, wherein the lower edge of the main plate is linear.

5. The heavy-duty mobile demolition tool according to claim 4 wherein the upper jaw tip is on a distal portion of the lower edge.

6. The heavy-duty mobile demolition tool according to claim 4 wherein the upper jaw tip is intermediate of the lower edge of the upper jaw.

7. The heavy-duty mobile demolition tool according to claim 1 further comprising an upward tooth-like tip on a distal portion of the upper jaw.

8. The heavy-duty mobile demolition tool according to claim 1 wherein the lips are slightly above the cross plate to assist in cradling the material.

9. The heavy-duty mobile demolition tool according to claim 1 wherein the spaced apart plates and upper lips have distal portions with one tip of the array on each distal portion of the lips.

10. The heavy-duty mobile demolition tool according to claim 1 further comprising a downward tooth-like tip on a distal portion of the lower jaw.

11. The heavy-duty mobile demolition tool according to claim 1 wherein the tips are pyramid-like in shape.

12. A heavy-duty mobile demolition tool for attachment to the boom and hydraulic system of a hydraulic excavator, comprising a frame means mountable on the boom, a pair of upper and lower demolition jaws pivotally connected to each other as to be opened and closed relative to each other, at least one of the jaws being pivotally mounted on the frame means as to be movable for opening and closing the jaws relative to each other, a hydraulic cylinder mounted on the frame means and connected with the at least one moveable jaw for producing swinging thereof, the upper jaw having a main plate with a lower edge having a tooth-like tip, the lower jaw having spaced apart plates with upper lips, a cross plate joining the spaced apart plates, and an array of tooth-like tips on the lips and cross plate which are indirectly confronting, staggered and linear in relation to the tip of the upper jaw when the jaws are pivoted to the closed position, wherein the jaw plates have outer end portions spaced from the frame means and three of said tips being disposed adjacent said outer end portions and are linear in relation to each other when the jaws are closed whereby a demolition force may be exerted against a material so as to cause breaking of it into smaller pieces.

13. A heavy-duty mobile demolition tool for attachment to the boom and hydraulic system of a hydraulic excavator, comprising a frame means mountable on the boom, a pair of demolition jaws pivotally connected to each other as to be opened and closed relative each other, the jaws also being pivotally mounted on the frame means as to be variously oriented relative to the frame means, the jaws having open and closed positions, a pair of hydraulic cylinders mounted on the frame means, each of the cylinders being connected to a respective demolition jaw for pivotally moving the jaw relative to the frame means and to open and close the jaws relative to each other, and the jaws having an array of tooth-like tips which are staggered in relation to each other and indirectly confronting each other when the jaws are in the closed position, one of the jaws having a first, distally oriented tip and a second tip located rearwardly of the distally oriented tip, the other of the jaws including two spaced apart plates disposed transversely of the hydraulic cylinders, the spaced apart plates being joined by a cross plate with third and fourth tips being disposed medially of the spaced apart plates, the spaced apart plates having fifth and sixth distally oriented tips, the tips forming the shape of a "T" when the jaws are in the closed position whereby a demolition force may be exerted against a material as to cause breaking of it into smaller pieces.

14. The heavy-duty mobile demolition tool according to claim 13 and said demolition jaws swinging through operational arcs as the jaws are open and closed relative to each other and as the hydraulic cylinders and extended and retracted, the size of the operational arc and the directions of thrust from said cylinders causing nearly uniform demolition force to be applied by said jaws onto the workpiece throughout the operational arcs.

15. A heavy-duty mobile demolition tool for attachment to the boom and hydraulic system of a hydraulic excavator, comprising a frame means mountable on the boom, a pair of upper and lower demolition jaws pivotally connected to each other as to be opened and closed relative to each other, at least one of the jaws being pivotally mounted on the frame means as to be movable for opening and closing the jaws relative to each other, a hydraulic cylinder mounted on the frame means and connected with the at least one moveable jaw for producing swinging thereof, the upper jaw having a main plate with a lower edge having a tooth-like tip on a distal portion of the lower edge and another tooth-like tip that is located intermediate of the lower edge of the upper jaw, the lower jaw having spaced apart plates with upper lips, a cross plate joining the spaced apart plates, and an array of tooth-like tips on the lips and cross plate which are indirectly confronting, staggered and linear in relation to the tip of the upper jaw when the jaws are pivoted to the closed position, the tips of the upper jaw and lower jaw form the shape of a "T" when the jaws are closed for inducing stress lines in an object to be crushed whereby a demolition force may be exerted against a material so as to cause breaking of it into smaller pieces.

* * * * *